US005584287A

United States Patent [19]

Smith et al.

[11] Patent Number: 5,584,287

[45] Date of Patent: Dec. 17, 1996

[54] SAFETY SYSTEM FOR SCUBA DIVERS INCLUDING CO DETECTION

[76] Inventors: Jack V. Smith; Jesse M. Carter, both of P.O. Box 3363, Seminole, Fla. 34642

[21] Appl. No.: 492,583

[22] Filed: Jun. 20, 1995

[51] Int. Cl.[6] ..... A62B 7/00

[52] U.S. Cl. ..... 128/202.22; 128/202.27; 128/205.22; 128/205.23

[58] Field of Search ..... 128/202.22, 202.27, 128/200.24, 204.18, 205.22, 205.23, 202.14; 422/86, 87; 73/864.33, 863.71, 23.2, 23.24, 31.03

[56] References Cited

U.S. PATENT DOCUMENTS

| | | | |
|---|---|---|---|
| 4,656,008 | 4/1987 | Gump | 422/86 |
| 4,728,499 | 3/1988 | Fehder | 422/56 |
| 4,994,117 | 2/1991 | Fehder | 436/133 |
| 5,417,204 | 5/1995 | Moesle, Jr. | 128/205.23 |

*Primary Examiner*—V. Millin
*Assistant Examiner*—Eric P. Raciti

[57] ABSTRACT

A scuba diver's toxic gas detector, in particular carbon monoxide detector, for use with conventional diving equipment and/or dive equipment filling systems, having a body portion (34) and a detector portion (32). The body portion (34) includes a first opening (42) therethrough communication at opposite ends thereof with connections for a first hose (14) from an air tank and a second hose(16) from a buoyancy vest (12). The body portion (34) includes another opening (50) in fluid communication with the first opening in which is positioned a guide element (68). A movable stem element (75) is positioned within said guide element (68). A bore (64) extends between the second opening (50) and the detector portion (32). A button (80) is connected to the stem element (75) and is biased in one position by a spring (82). Actuation of the button (80) results in fluid communication between the first opening (42) in the body portion (34) and the detector portion (32), further resulting in an detectable response for the presence of carbon monoxide.

1 Claim, 4 Drawing Sheets

SAFETY SYSTEM FOR SCUBA DIVERS INCLUDING CO DETECTION

TECHNICAL FIELD

This invention relates generally to safety equipment for divers and more specifically concerns an carbon monoxide detecting device for use with conventional scuba diving equipment and high pressure systems for filling scuba tanks.

BACKGROUND ART

It is well recognized that divers, particularly divers using scuba-type equipment, should ensure the quality of the compressed air in the scuba tanks. Carbon monoxide detectors are not typically used by divers. In many cases, the circumstances in which air is compressed to fill the tanks is less than optimal. It is imperative that attention be paid to the quality of the air compressed and the inadvertant addition of carbon monoxide which can cause severe illness and/or death. It is known in the art that exposure to approximately 0.05% carbon monoxide gas over an extended period of time or 1% for a few minutes could prove fatal. It is of the upmost importance to commercial and recreational divers to prevent the opportunity for tragedy.

Thus, using carbon monoxide detecing devices to insure air quality should be an important part of a diver's equipment. Carbon monoxide detectors are now known, and often are referred to as smoke detectors or carbon monoxide sensors although similar devices respond to the presence of fumes and particurly carbon monoxide. They are arranged so that when the concentration of the fumes reaches a certain level, a signal is produced which is often translated to a visual light signal or sound signal. However, such carbon monoxide detector devices have in the past typically been limited to detecting carbon monoxide in non-pressurized systems (i.e., ambient room air pressure U.S. Pat. Nos. 5,379,026 or 5,132,231). Such carbon monoxide detector devices, however, are often not very effective in obtaining the desired result, particularly since there is no way to introduce a high pressure system (up to as much as 10,000 lb ft-2) to an open method and prevent all of the air from the system being tested to leak out. Further, the known carbon monoxide detector devices are all rather bulky and cumbersome to use, which discourages a diver from using them, and in any event will not function in a water environment so it is not useful to divers. Typically, carbon monoxide detecting devices are not and never have been designed for scuba divers prior to the present device. While general purpose devices for detecting carbon monoxide in a room as mentioned above are reasonable and convenient, such a device cannot be attached to the high/or low pressure line of sucba diving equipment but would require the diver to release all the air from the tank into the room defeating the purpose of checking the air because now the tank has to be refilled and retested. While these devices fulfill their respective, particular objectives and requirements, the aforementioned patents do not describe a toxic gas detector and/or carbon monoxide detector designed for alerting divers to the presence of carbon monoxide gas which utilizes a device that is attachable to a scuba diving system. Further, there is a significant need in the art for a carbon monoxide detector device which is both convenient and practical to use, but which also is capable of detecting carbon monoxide with minimum effort by the diver or by a technician filling a dive tank.

DISCLOSURE OF THE INVENTION

Accordingly, the invention includes a means for receiving air under pressure from a diver's tank for forwarding the air received from said diver's tank for inflation of a buoyancy vest, means responsive to air which is under pressure to produce an detectable resonse to the presence of carbon monoxide and means operable by a diver for selectively diverting at least a portion of the pressurized air received from the diver's tank to said detector means, which results in the detection of carbon monoxide in the tank if present.

BEST MODE FOR CARRYING OUT THE INVENTION

Figure 1:
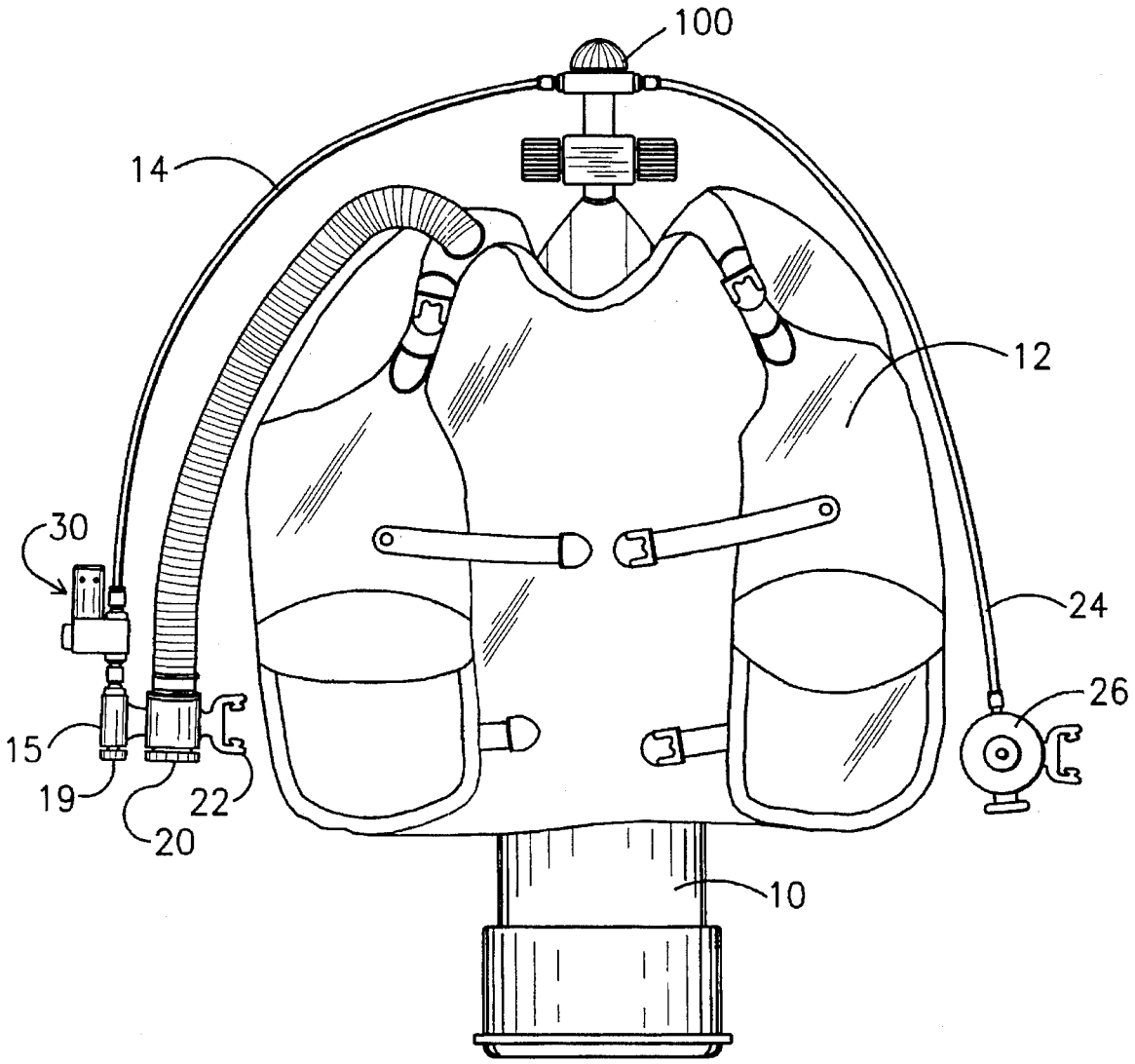
FIG. 1 is an environmental view showing the carbon monoxide detecting apparatus of the present invention connected with conventional scuba diving equipment.

The present invention is a detector, i.e. an Carbon monoxide detecting device, which is specifically designed and arranged to be used as an integral part of conventional scuba diving equipment and/or high pressure scuba tank filling systems. Referring now to FIG. 1, certain elements of conventional scuba diving equipment are shown, including a scuba tank 10 containing compressed air and a buoyancy compensator vest 12, which provides control over buoyancy for the scuba diver. Inflation of the vest results in increased buoyancy, while deflation of the vest decreases buoyancy.

Conventionally, air from the tank 10 is provided through a low pressure hose 14 to an inflation/exhaust valve assembly 15 and from there through a corrugated inflation hose 16 to the buoyancy compensator vest 12. Conventionally, vest 12 is inflated with compressed air by actuation of an inflater button 19 associated with inflation/exhaust valve assembly 15, while air is released from the vest 12 by actuation of deflation button 20. In addition, vest 12 may be inflated orally by the diver through mouth piece 22. Another hose 24 is directed to a pressure regulator 26 and from there to the diver's mouth piece (not shown). The actual connection between the corrugated hose 16 and the vest 12 is not shown, although it is typically approximately in the middle of the vest 12.

Figure 2:
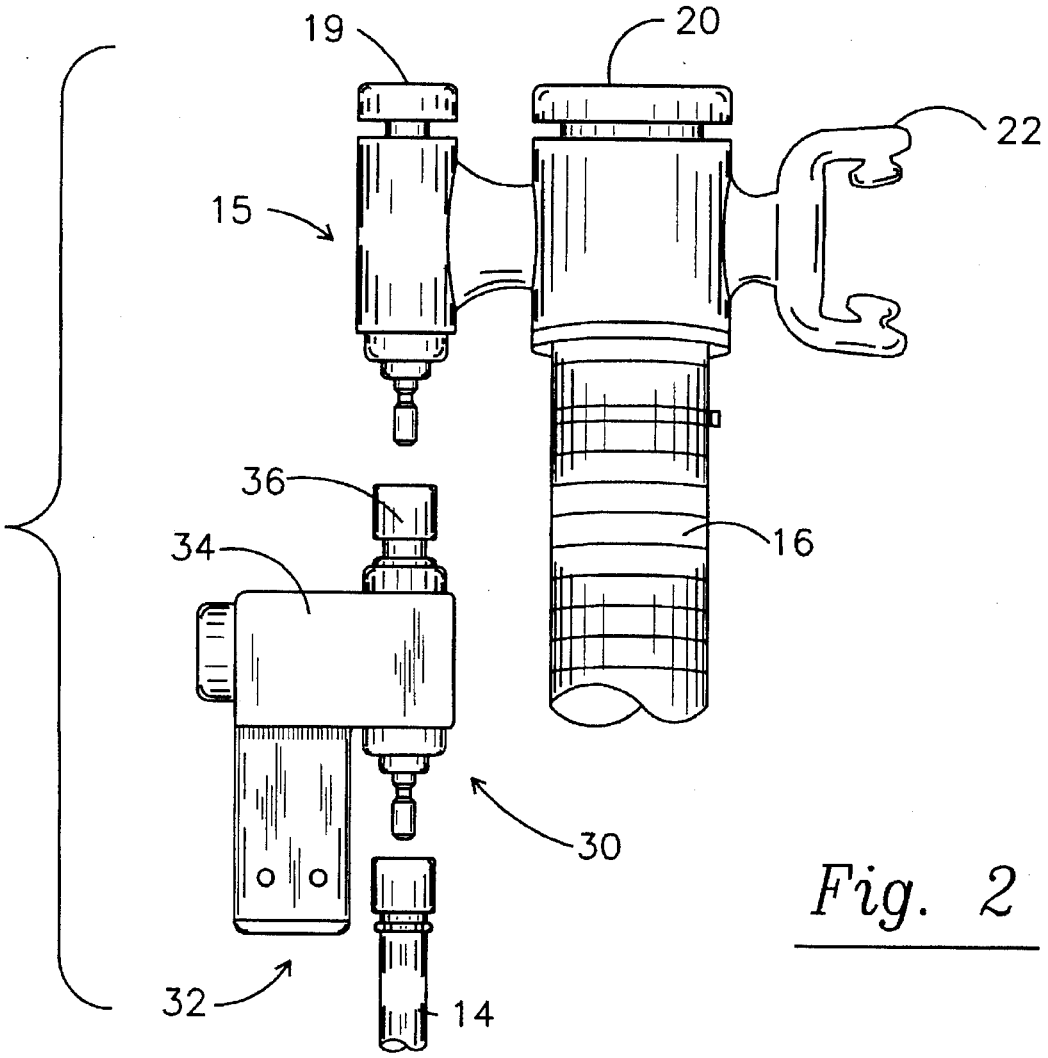
FIG. 2 is an environmental view showing a portion of the apparatus of FIG. 1.

Typically, quick connect/disconnect fittings are attached to the air hose 14 and the inflation/exhaust valve assembly 15, in the vicinity of the inflater button 19. The carbon monoxide detecting apparatus of the present invention, shown generally at 30 in FIGS. 1 and 2, is connected between hose 14 and inflation/exhaust valve assembly 15. The carbon monoxide detector apparatus includes a detector portion 32 and a body portion 34, which includes a female connector 36, and a male connector 38, which in turn are connected by an interior passageway (not shown in FIG. 2). The female connector 36 is adapted to quick connect/disconnect with inflation/exhaust valve assembly 15, which male connector 38 is adapted for quick connect/disconnect with low pressure hose 14. Hence, the present invention is a carbon monoxide detector which is adapted to be readily integrated with conventional scuba diving equipment, without any modification to the scuba equipment and without in any way interfering with its normal operation.

Figure 3:
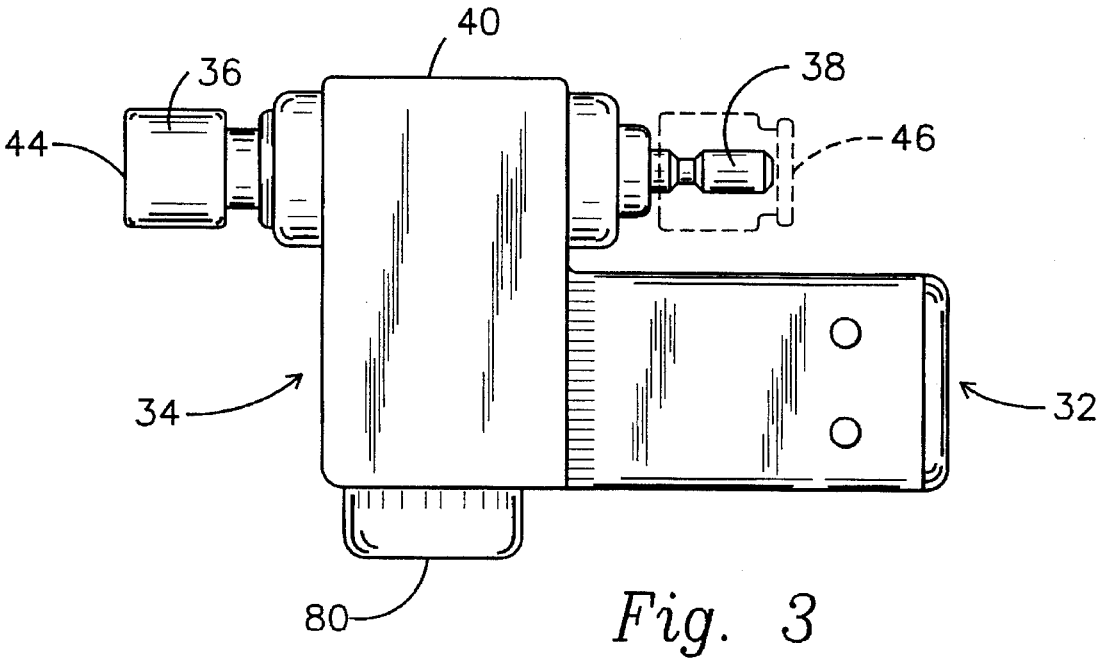
FIG. 3 is a side elevational view of the carbon monoxide detecting apparatus of the present invention.
Figure 4:
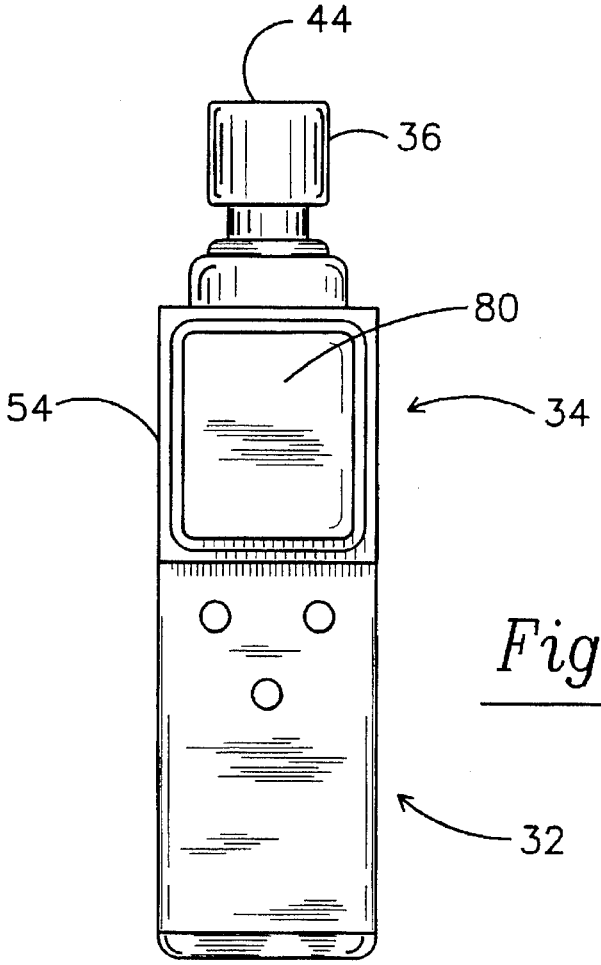
FIG. 4 is a top plan view of the apparatus of FIG. 3.
Figure 5:
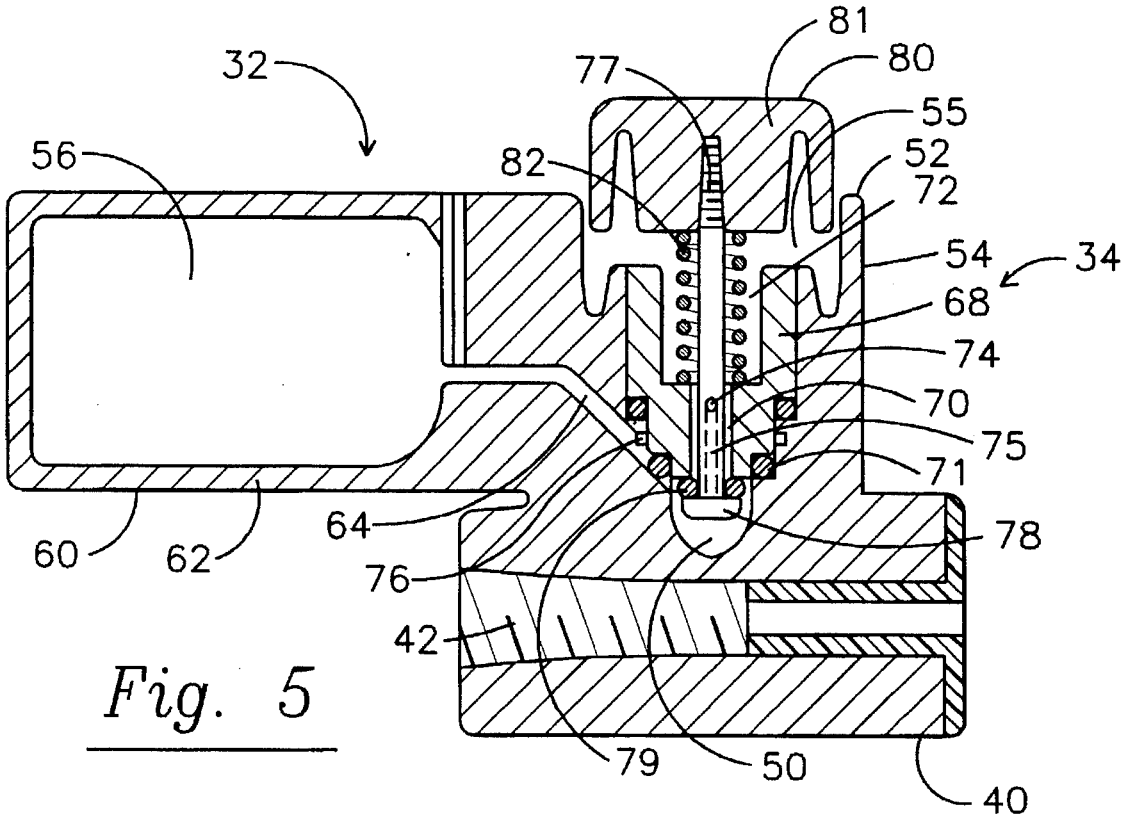
FIG. 5 is a cross sectional view of the apparatus of FIG. 6, taken along lines 6—6 in FIG. 4.
Figure 6:
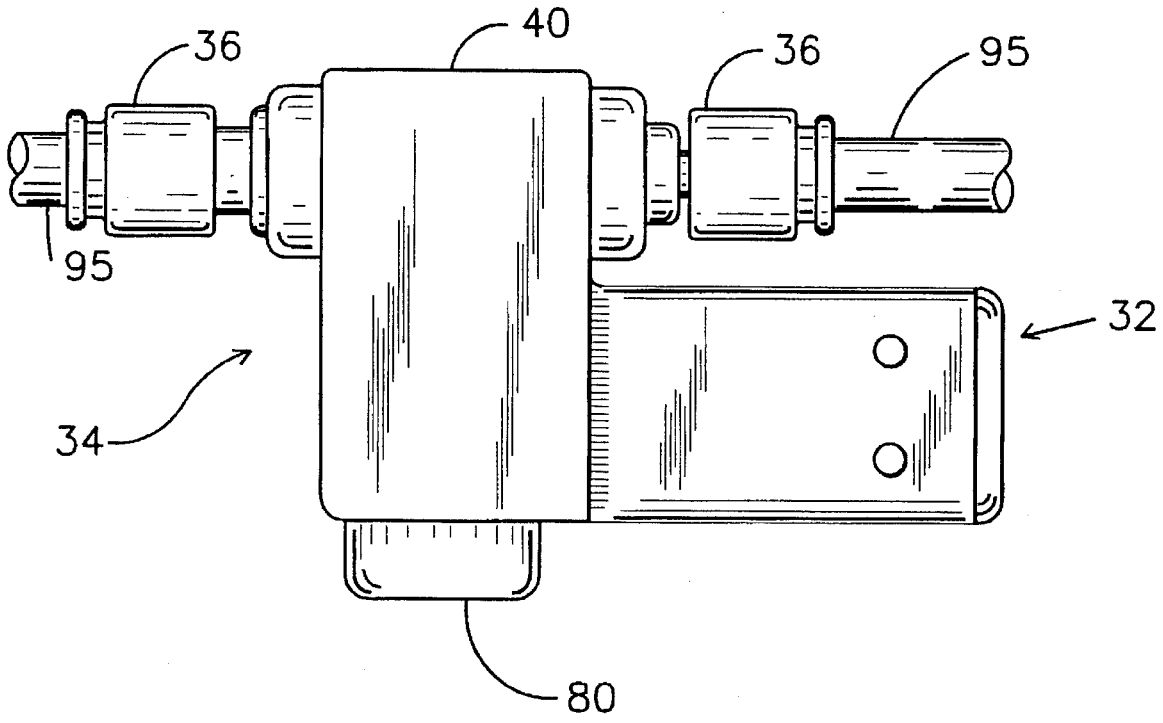

FIGS. 3–5 show the details of the carbon monoxide detector apparatus of the present invention. As disclosed briefly above, the carbon monoxide detector apparatus includes a detector portion 32 and a body portion 34, the body portion including a section 40 thereof which in turn includes a straight interior opening or passageway 42 which extends between female connector 36 at one end 44 (FIG. 1) which connects the alarm apparatus to low pressure hose 14 and a male connector 38 at the other end 46 which connects the alarm apparatus to the inflation/exhaust valve assembly 15. Additionally the carbon monoxide detector apparatus in FIG. 6 includes a detector portion 32 and a body portion 34, which includes a female connector 36 on one end, and a female connector 36 on the opposite end, which in turn are connected by an interior passageway (not shown in FIG. 2). The female connectors 36 are adapted to quick connect/disconnect with inlet/outlet hose 95 (from a high pressure filling system, not shown), Hence, the present invention is a carbon monoxide detector which is adapted to be readily integrated with conventional scuba diving equipment filling system, without any modification to the scuba equipment or scuba tank filling system and without in any way interfering with its normal operation.

In one operating mode or condition, compressed air is directed straight through the passageway 42 in body portion 34 from the low pressure hose 14 to the inflation/exhaust valve assembly 15. In this mode, the scuba equipment operates conventionally, in fact as if the carbon monoxide detector apparatus of the present invention was not present.

The body portion 34 also includes an internal opening 50 which extends from passageway 42 upwardly through body 34. The opening 50, which is circular in cross-section, increases in diameter from 0.1 inches at passageway 42 in three steps to a diameter of approximately 0.6 inches. The sides of opening 50 in the embodiment shown have a 1 inward draft. Bounding the top of opening 50 is a circular lip 52 which is approximately 0.11 inches high. Outward from lip 52 is a wall 54, which is configured to define a square volume 55, approximately 1 inch on a side.

The detector portion 32 element which is integral with and extends from the body portion 34. Generally, the detector 32 is positioned to the side of and extends somewhat above the position of the opening 50 in the body portion 34. The detector 32 includes a cavity 56 which is defined by a circular peripheral wall 60 and a lower surface 62. In the embodiment shown, the peripheral wall has an internal diameter of approximately 1.0 inches, with a 1.0 inche inward draft from top to bottom, and is approximately 1.0 inches deep.

An angular bore 64 approximately 0.05 inches in diameter connects the lower part of opening 50 in body portion 34 with the detector outlet portion, at a point approximately mid-height of cavity 56.

Positioned within the opening 50 in the body 34 is a button stem guide 68. Generally, button stem guide 68 is configured to mate with the configuration of opening 50, and extends from the top of opening 50 to the middle step or lip 70 thereof. O-rings 71—71 are positioned at selected points around button stem guide 68 which provide a fluid-tight seal between the button stem guide 68 and the opening 50. Extending longitudinally completely through the button stem guide 68 is a central axial opening 72. Opening 72 includes an upper portion having diameter of approximately 0.34 inches, and a narrow lip immediately below the first portion which has a diameter of approximately 0.23 inches and a lower portion having a diameter of approximately 0.15 inches.

Extending through the wall of the button stem guide in the lower portion of the axial opening 72 with a peripheral groove 76 which extends around the exterior surface of the button stem guide near the bottom end thereof, at a point such that the end of bore 64 which opens into opening 50 is in registry therewith. There is thus a fluid-continuous passage between passageway 42, opening 50, axial opening 72, lateral opening 74, groove 76 and bore 64, leading to cavity 56 in detector 32.

Positioned within the button stem guide 68 is a elongated button stem 75. Button stem 75 is the form of a bolt which includes a shank 77, the upper free end of which is threaded, and a head 78. The diameter of the shank 77 is slightly less than the diameter of the lower portion of axial opening 72 in the button stem guide 68. The button stem is positioned such that the head 78 of the stem, which has a larger diameter than the lower portion of opening 72, is positioned below the lower surface of the button stem guide 68. An O-ring 79 is positioned beneath the head of the button stem 75 to provide a fluid tight seal between the button stem 75 and the button stem guide 68.

The upper free end of the button stem 75 is threaded into a square button 80 which in the embodiment shown is 0.82 inches on a side so that it fits into the square volume 55 defined by wall 54. The button 80 includes a central depending cylindrical portion 81 into which the button stem is threaded, and an outer square wall defining the outer surface of the button, leaving a space between the cylindrical portion and the wall.

A spring 82 is positioned around a portion of button stem 75, between the lower surface of the cylindrical portion 81 of button 80 and the narrow lip defined in the axial opening 72 of button stem guide 68. A washer and O-ring are positioned beneath the spring 82, for fluid tight operation and reliable movement of the button stem within the button stem guide 68.

When the button 80 is depressed, compressing the spring 82, the head 78 of the button stem 75 moves downwardly, away from the lower surface of button stem guide 68, permitting compressed air to move from passageway 42 around the button stem and into the opening 72 in button stem guide 68 and from there, through lateral opening 74 in the button stem guide, into and around peripheral groove 76, and through bore 64 to the detector portion 32. When the button 80 is in its raised position, which is its biased position established by the spring 82, the head 78 of the button stem 75 is firmly positioned against the lower surface of button stem guide 68. The O-ring 79 beneath the head 78 prevents any fluid, i.e. compressed air, from reaching the axial opening 72 of the button stem guide 68. Hence, no compressed air reaches the detector.

In normal operations, the spring 82 biases the button 80 and hence the button stem 75 in their uppermost position, such that no air is permitted into the axial opening 72 of button stem guide 68 and hence there is no movement of air into the detector 32. The movement of air is thus straight through the body portion 34, directly between the low pressure hose 14 and the corrugated hose 16 connections.

However, for a detectable response to be noticed by the diver, alerting the diver to the presence of carbon monoxide within the tank (pressure system), the button 80 is depressed, thereby depressing button stem 75, such that the head portion 78 of button stem 75 is free of the lower surface of button stem guide 68, permitting compressed air to move from passageway 42 into the opening 50, then through the axial opening 72 and lateral opening 74 and then through groove 76 and finally through bore 64 into the cavity 56 of detector 32. This rush of air operates on the detector and causes a detectable response, attracting the desired attention of the diver of scuba tank filling technician.

Accordingly, an invention has been described which is capable of producing a detectable response in the presence of carbon monoxide, but which is adapted for integration into conventional scuba diving equipment. The resulting Combination is practical and easy to use, and does not otherwise interfere with the operation of the diving equipment or the actions of the diver.

Although a preferred embodiment of the invention has been disclosed herein for illustration, it should be understood that various changes, modifications and substitutions may be incorporated in such embodiment without departing from the spirit of the invention as defined by the claims which follow. It should be understood, for instance, that the structure of the present invention could be made integral with an inflation/exhaust valve assembly, i.e. assembly 15 in FIGS. 2 and 3, or with the first stage 100 in FIG. 1, or any other mechanism that could be connected to the scuba system such as a dive computer, control panel, or other devices (not shown in the drawings). And that the carbon monoxide detecting device can be configured to detect other toxic gases such as cyanide, etc.

We claim:

1. An apparatus for use with diving equipment to produce a detectable response in the presence of carbon monoxide comprising:

means, including air control for receiving air under pressure from a scuba diving tank for inflation of a diver's buoyancy vest;

means responsive to air under pressure to produce a detectable response with said means being adapted to be carried with said inflation means during diving operations, without interfering therewith; and means selectively operable by a diver for diverting a portion of the pressurized air through an opening in said inflation means to said detector means to produce a detectable response to the presence of carbon monoxide, wherein the means positioned in said opening includes an insert having a fluid-tight relationship with the body portion, the insert having a central axial opening and an elongated stem-like element movably positioned within the central axial opening, the insert further including a peripheral groove around the exterior surface thereof, the groove being in fluid communication with said bore-like passageway, said insert also including a lateral opening which extends between the central axial opening of said insert and the peripheral groove thereof, the apparatus further including a button element connected to the stem-like element and a spring biasing the button and hence the stem-like element in a first position in which a head portion of the stem-like element closes off the central axial opening of the insert, the stem-like element being further arranged relative to the spring that when the button is depressed, the stem-like element moves away from the central opening of the insert, permitting fluid to move thereinto.

* * * * *